US011000105B2

(12) United States Patent
Howard

(10) Patent No.: US 11,000,105 B2
(45) Date of Patent: May 11, 2021

(54) TOOL HOLDER

(71) Applicant: Vale Mill (Rochdale) Limited, Lancashire (GB)

(72) Inventor: Michael Howard, Rochdale (GB)

(73) Assignee: VALE MILL (ROCHDALE) LIMITED, Lancashire (GB)

( * ) Notice: Subject to any disclaimer, the term of this patent is extended or adjusted under 35 U.S.C. 154(b) by 0 days.

(21) Appl. No.: 16/799,204

(22) Filed: Feb. 24, 2020

(65) Prior Publication Data

US 2020/0268123 A1 Aug. 27, 2020

(30) Foreign Application Priority Data

Feb. 26, 2019 (GB) ..... 1902581

(51) Int. Cl.
*A45D 20/12* (2006.01)
*A45D 1/00* (2006.01)

(52) U.S. Cl.
CPC ..... *A45D 20/12* (2013.01); *A45D 2001/002* (2013.01); *A45D 2020/126* (2013.01); *A45D 2200/152* (2013.01)

(58) Field of Classification Search
CPC ..... A45D 2020/126; A45D 2020/128; A45D 20/12; A45D 1/00; A45D 2001/002; A45D 2200/05; A45D 2200/152; A45C 11/26
USPC ..... 248/683, 206.5; 132/312; 206/349, 361, 206/15.3, 581, 320
See application file for complete search history.

(56) References Cited

U.S. PATENT DOCUMENTS 2,354,018 A * 7/1944 Heltzer ..... G09F 13/16 359/538
2,641,793 A * 6/1953 Wilm ..... A47J 45/10 16/435
4,570,792 A * 2/1986 Conway ..... A45D 6/00 206/349
4,973,019 A * 11/1990 Baird ..... A45D 1/00 248/117.1
5,141,189 A * 8/1992 Andrew ..... A45D 1/00 211/70.6
D332,670 S * 1/1993 McFarland ..... D28/38
(Continued)

FOREIGN PATENT DOCUMENTS

GB 2431136 A * 4/2007 ..... B32B 15/08
GB 2451919 A * 2/2009 ..... A45D 6/18
(Continued)

OTHER PUBLICATIONS

GB Search Report, dated Aug. 16, 2019, from corresponding GB application No. 1902581.6.

*Primary Examiner* — Kimberly T Wood
(74) *Attorney, Agent, or Firm* — Nixon & Vanderhye

(57) ABSTRACT

A tool holder includes a support stand which provides support for a protective wall that at least in part defines an enclosure within which a tool may be stored, the protective wall including a sheet of heat resistant material which at least in part is selectively releasable from and securable to the support stand, the sheet of heat resistant material being a flexible sheet whereby in a first orientation it serves as the protective wall but at least in part may be released from the support stand to provide a substantially flat heat resistant mat on which to rest a heated tool during periods of use of the tool.

20 Claims, 9 Drawing Sheets

(56) References Cited

U.S. PATENT DOCUMENTS 5,460,305 A * 10/1995 Ahearn ..... B25H 5/00 224/562
5,577,607 A * 11/1996 Drake ..... A45D 1/00 150/161
5,743,415 A * 4/1998 Smart ..... A45D 20/12 211/70.6
5,878,757 A * 3/1999 Hernandez ..... A45D 6/00 132/287
5,950,826 A * 9/1999 Lykowski ..... A45C 11/008 190/102
6,068,122 A * 5/2000 Burns ..... A45D 1/00 206/372
6,070,729 A * 6/2000 Barnes ..... A45C 11/26 206/373
6,123,299 A * 9/2000 Zach, Sr. ..... A45D 1/00 248/117.1
8,430,241 B1 * 4/2013 Balogh ..... A45D 6/18 206/349
8,689,999 B2 * 4/2014 Cooper ..... A45D 44/04 220/507
9,472,127 B2 * 10/2016 Tatum ..... G09F 7/08
10,799,076 B2 * 10/2020 Manko ..... A47K 10/12
2005/0092344 A1 * 5/2005 Mooney ..... A45D 1/00 132/312
2009/0173648 A1 * 7/2009 Geneva ..... A45C 11/008 206/320
2014/0034791 A1 * 2/2014 Cooper ..... A45D 44/00 248/163.1
2015/0041417 A1 * 2/2015 Christenson ..... A45D 44/04 211/26
2018/0103744 A1 * 4/2018 Moore ..... A45D 44/06
2018/0263349 A1 * 9/2018 Cooper ..... A45C 11/00
2020/0297092 A1 * 9/2020 Green ..... A61Q 5/12

FOREIGN PATENT DOCUMENTS

GB 2451919 A 2/2009
GB 2506101 A * 3/2014 ..... A45D 1/00
GB 2523218 A * 8/2015 ..... A45D 20/12
GB 2523218 A 8/2015
WO WO-2019014149 A1 * 1/2019 ..... A45D 1/00

* cited by examiner

TOOL HOLDER

BACKGROUND OF THE INVENTION

Field of the Invention

This invention relates to a tool holder and in particular, though not exclusively, to a tool holder for containing a heated tool such as, for example, an electrically heated hair styling tool.

SUMMARY OF THE INVENTION

The invention seeks to provide a tool holder which is able to store a heated tool as it gradually cools and which protects persons from inadvertently touching the heated tool whilst the tool is contained in the holder. The invention seeks also to provide a protective surface on which to rest a heated tool whilst in use and thereby protect an underlying support surface from damage.

In accordance with one aspect of the present invention there is provided a tool holder comprising a support stand which provides support for a protective wall that at least in part defines an enclosure within which a tool may be stored, said protective wall comprising a sheet of heat resistant material which at least in part is selectively releasable from and securable to the support stand, said sheet of heat resistant material being a flexible sheet whereby in a first orientation it serves as said protective wall but at least in part may be released from the support stand to provide a substantially flat heat resistant mat on which to rest a heated tool during periods of use of the tool.

Preferably the flexible sheet is wholly removable from the stand but alternatively part of the sheet may remain attached to the stand whilst the remainder of the sheet is laid flat on a table or other support surface.

Preferably at least one magnet is provided whereby at least in part the flexible sheet is readily securable magnetically to and removable from a support stand. A magnet may be secured to either the sheet or the stand and the other of the sheet and stand may comprise a magnetic element which may be either another magnet or other magnetic material, such as a ferrous metal which co-operates with the magnet to releasably secure the flexible sheet to the support stand.

Preferably the magnet and magnetic element are positioned and dimensioned in a manner that ensures that the flexible sheet can be magnetically secured to the stand only at one position, or within a limited range of positions of the sheet material relative to the stand. Thus that relative position or limited range is selected such that there is avoided the risk of misalignment of the flexible sheet and stand and also the related risk of the flexible sheet not adequately surrounding all of the heated part of a tool which is stored in the tool holder.

The flexible sheet may be of a rectangular shape, such as a square, and an edge of the sheet may incorporate a substantially rigid enforcing element to assist in controlling movement of the sheet, particularly when moving from an unfolded, flat orientation, to a position in which it is secured to the tool holder to serve as said protective wall.

If the flexible sheet is wholly removable from the support stand, preferable it is of a substantially rectangular shape. Each of two opposite edges of the sheet may be reinforced to assist placing the sheet into contact with the support stand.

The reinforcement at an edge of the strip preferably is of non-magnetic material. Alternatively it may be of magnetic material and may be covered with non-magnetic material, such as the heat resistant material of the mat whereby that reinforcement does not function as part of the means for magnetic attachment of the sheet material to the support stand. The reinforcement, whether or not magnetic, may be at least partially embedded within the flexible sheet. The flexible sheet may comprise ferrous particles embedded in the material of the sheet.

Preferably an edge of the sheet material is provided with a small so-called button magnet or a similarly sized disc of ferrous material to co-operate with a correspondingly sized magnetic element secured to the support stand.

A suitable heat resistant material for the flexible sheet is silicone rubber.

The support stand preferably comprises a base section on which the end of a heated tool may rest. The base section may be of thermal conductivity material and/or of sufficient thickness to avoid undue heating of and damage to a support surface on which the stand is placed.

The base section may define an abutment surface against which an edge of the flexible sheet may abut when in position and secured to the support stand.

The base section may comprise a central floor section on which the end of a tool may rest, and said floor section may be surrounded by an upstanding rim. The upstanding rim may serve to define the profile of the flexible sheet when secured to the support stand and also inhibit any sideways movement of the end of the tool and which might otherwise contact and displace the flexible sheet.

The stand may comprise a column section which extends upwards from the base section. One or more magnetic elements may be secured to or incorporated in the column for co-operation with a magnet or magnetic element at an edge region of the flexible sheet.

The column may define two attachment surfaces each for attachment of a respective edge of a flexible sheet that is wholly removable from the support stand and which is provided with at least one magnet or magnetic element at each of two opposite edges of the sheet.

The column may comprise an abutment section which extends outwards from the column, preferably from an upper end region of the column for support of the flexible sheet. The abutment section may comprise a pair of support arms, such as curved arms the distal ends of which are spaced apart whereby when the flexible sheet is removed a tool may readily be positioned alongside the column or removed therefrom.

The column may comprise a cable storage facility for storage of the cable of an electrically heated tool. The cable storage may comprise two spaced lugs between which a cable may be wound. The cable storage may comprise a retention clip into which part of a cable may be clipped.

A reinforced edge region of the flexible sheet may comprise a tab section which extends outwardly beyond an edge of the flexible sheet that extends at right angles to the reinforced edge thereby to provide a tab which extends upwards beyond the column section support arms when the flexible sheet is assembled with the support stand thereby to facilitate subsequent separation of that reinforced edge from the column section.

The column section may be provided with a protrusion or recess for co-operation with a respective recess or protrusion at a reinforced edge of the flexible sheet thereby to assist correct positioning of the reinforced edge alongside the column section.

In accordance with a further aspect of the present invention there is provided a flexible support mat of heat resistant material wherein at least one edge of the mat is provided with a magnetic element. The magnetic element may, for example, be a solid ferrous element of may be an array of ferrous particles embedded in the sheet material. The flexible mat may comprise other features as described herein in the context of a flexible sheet of heat resistant material which is releasably securable to the support stand of a tool holder.

BRIEF DESCRIPTION OF THE DRAWINGS

Embodiment of the present invention will now be described by way of example only, with reference to the accompanying diagrammatic drawings in which.

DESCRIPTION OF THE PREFERRED EMBODIMENTS

Figure 1:
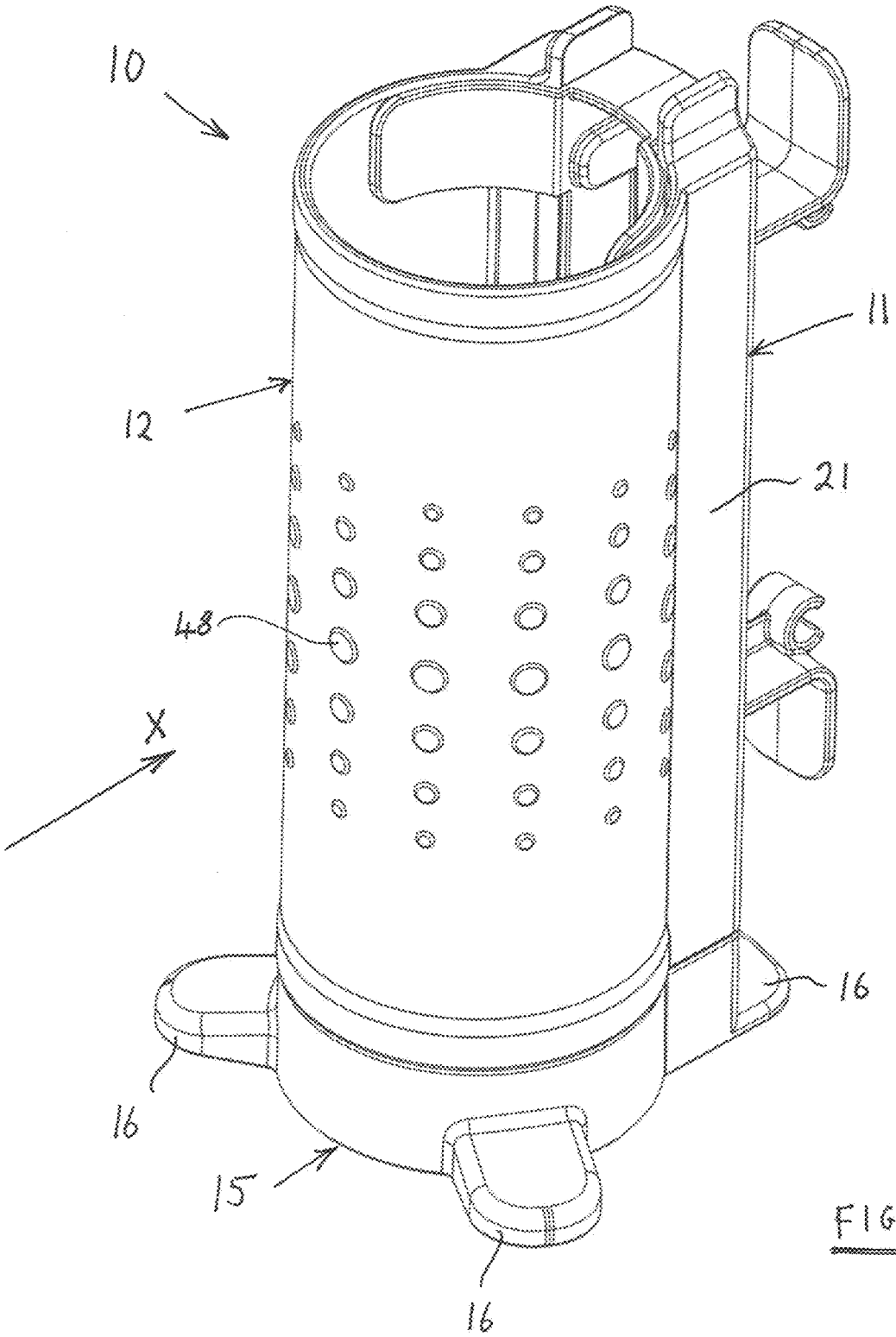
FIG. 1 is a perspective view of a tool holder in accordance with the present invention.
Figure 2:
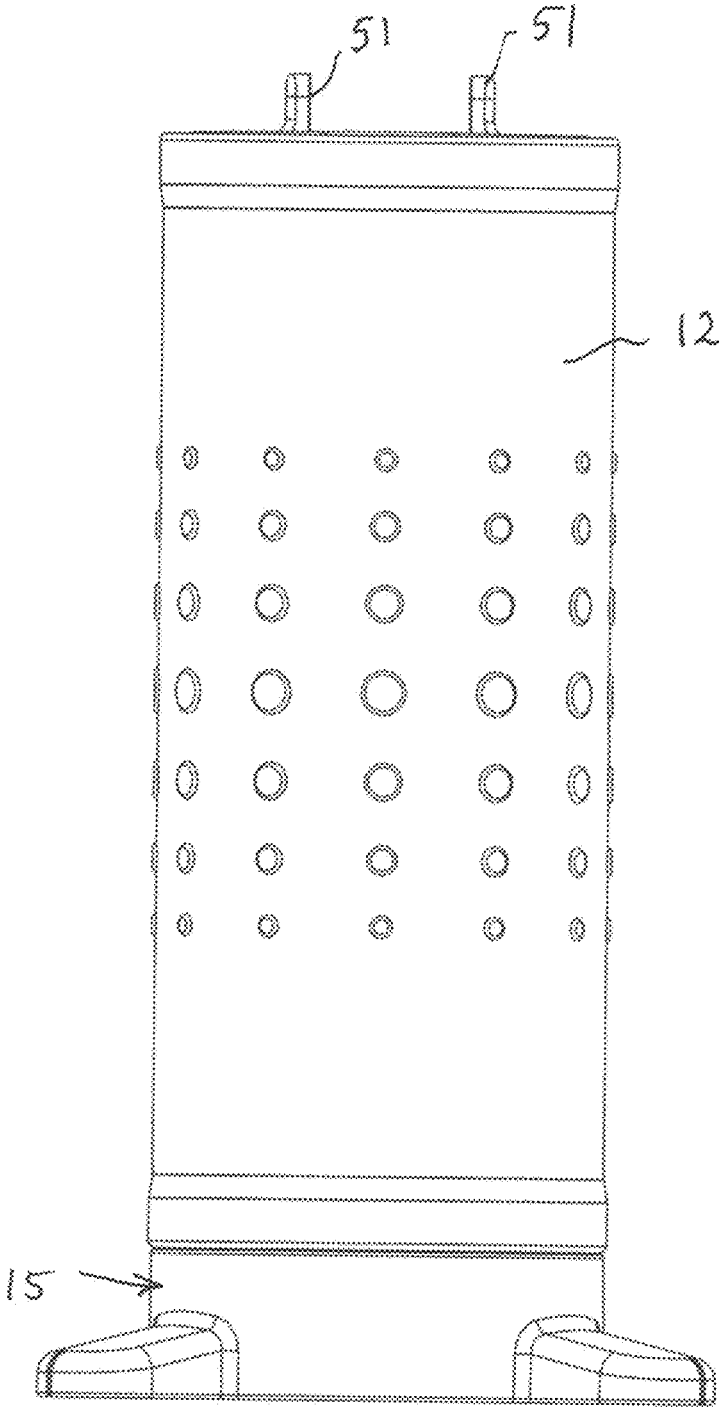
FIG. 2 is a front view of the tool holder of FIG. 1 in the direction of the arrow X of FIG. 1.
Figure 3:
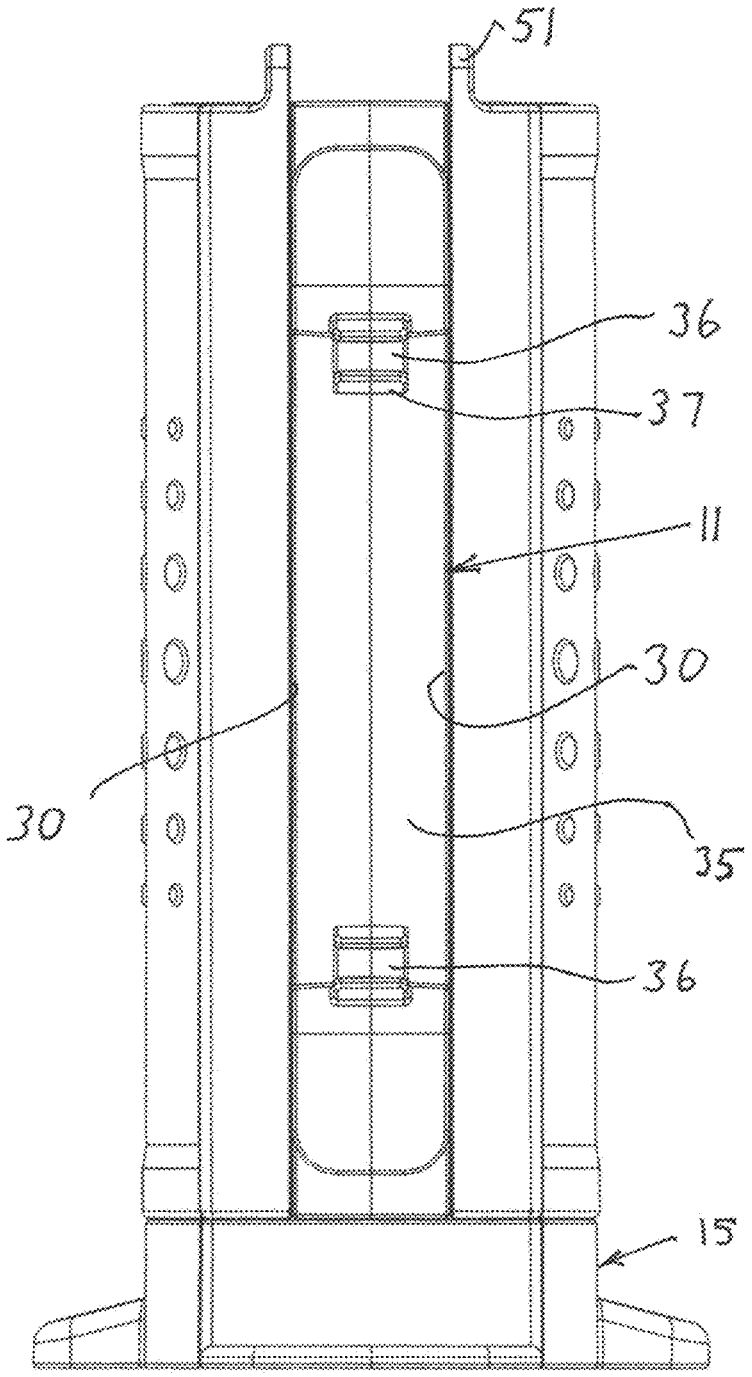
FIG. 3 is a rear view of the tool holder of FIG. 1.
Figure 4:
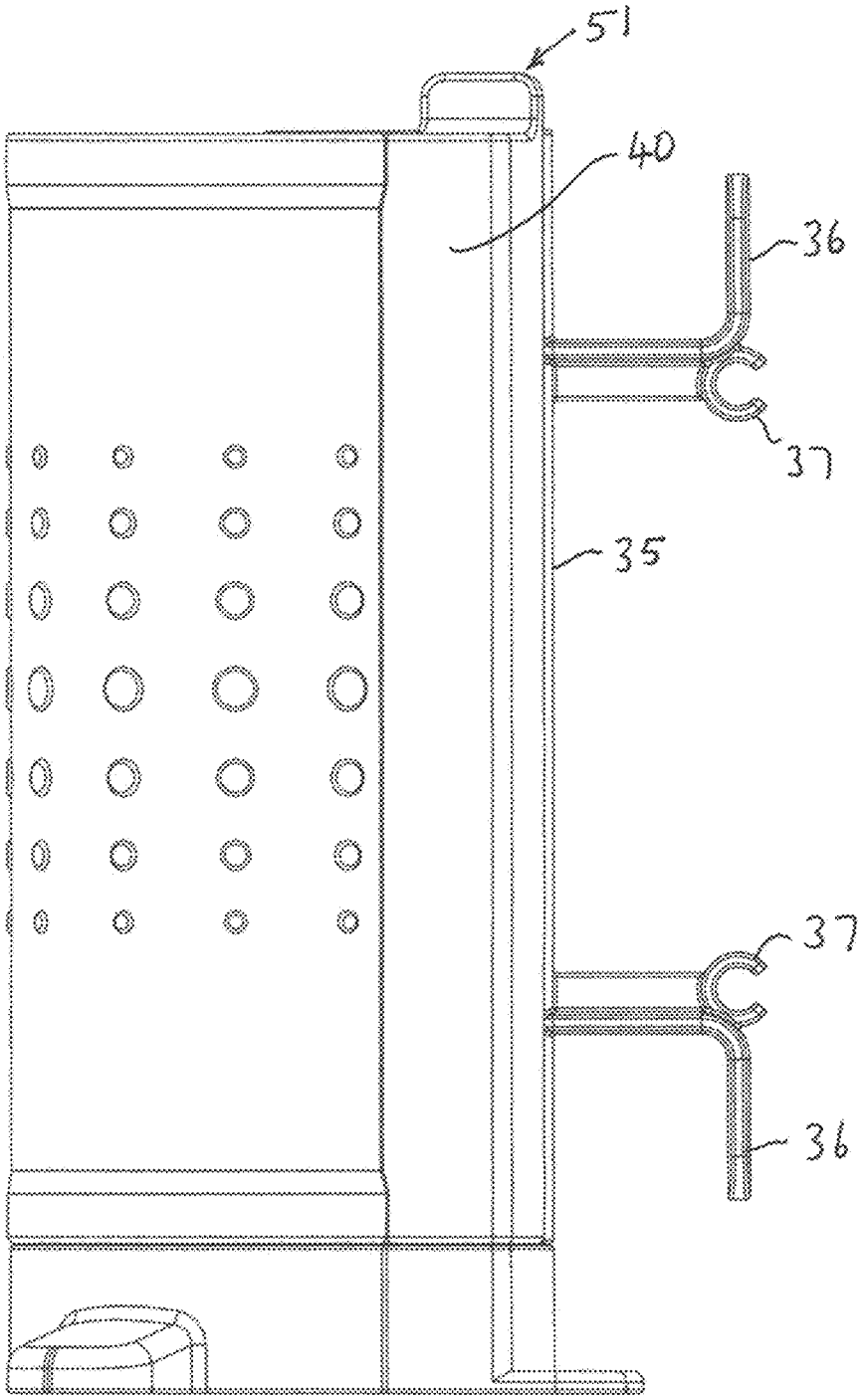
FIG. 4 is a side view of the tool holder of FIG. 1.
Figure 5:
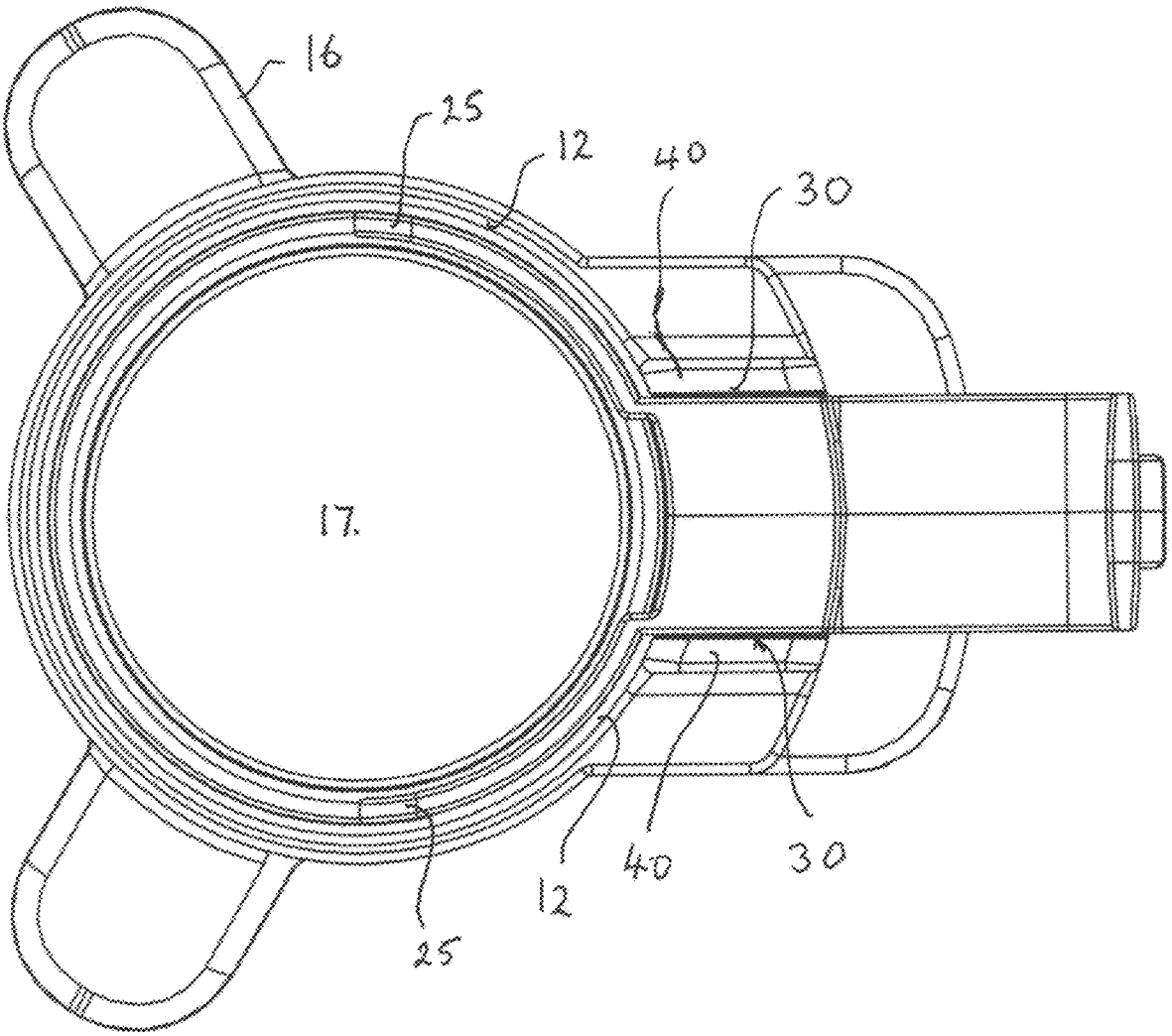
FIG. 5 is a plan view of the tool holder of FIG. 1 as viewed in a downward direction.

A tool holder 10 suitable for storing a heated tool such as a hair styling tool comprises a support stand 11 and a flexible silicone sheet 12. The flexible sheet 12 is releasably secured to the support stand whereby, when in situ secured to the stand, it functions as a protective wall to surround the heated tool but which may be removed from the stand and laid flat on a support surface to serve as a heat resistant mat on which to rest a heated tool during periods of use.

The support stand 11 comprises a generally circular base section 15 from which three feet 16 extend outwardly to enhance stability of the support stand. The underside of each foot 16 is co-planar with the underside of the generally circular base section.

Figure 6:
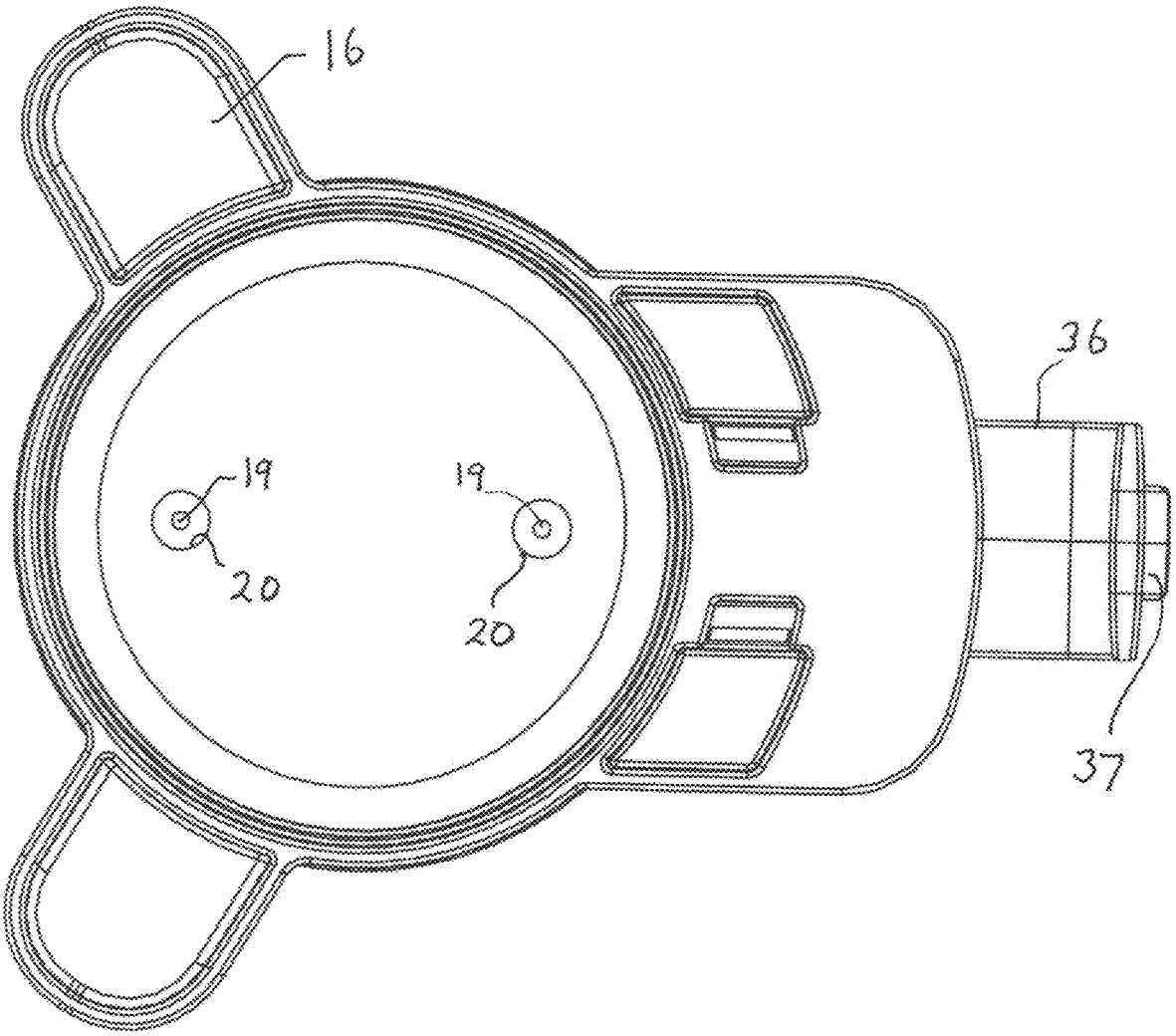
FIG. 6 is an end view of the underside of the tool holder.
Figure 8:
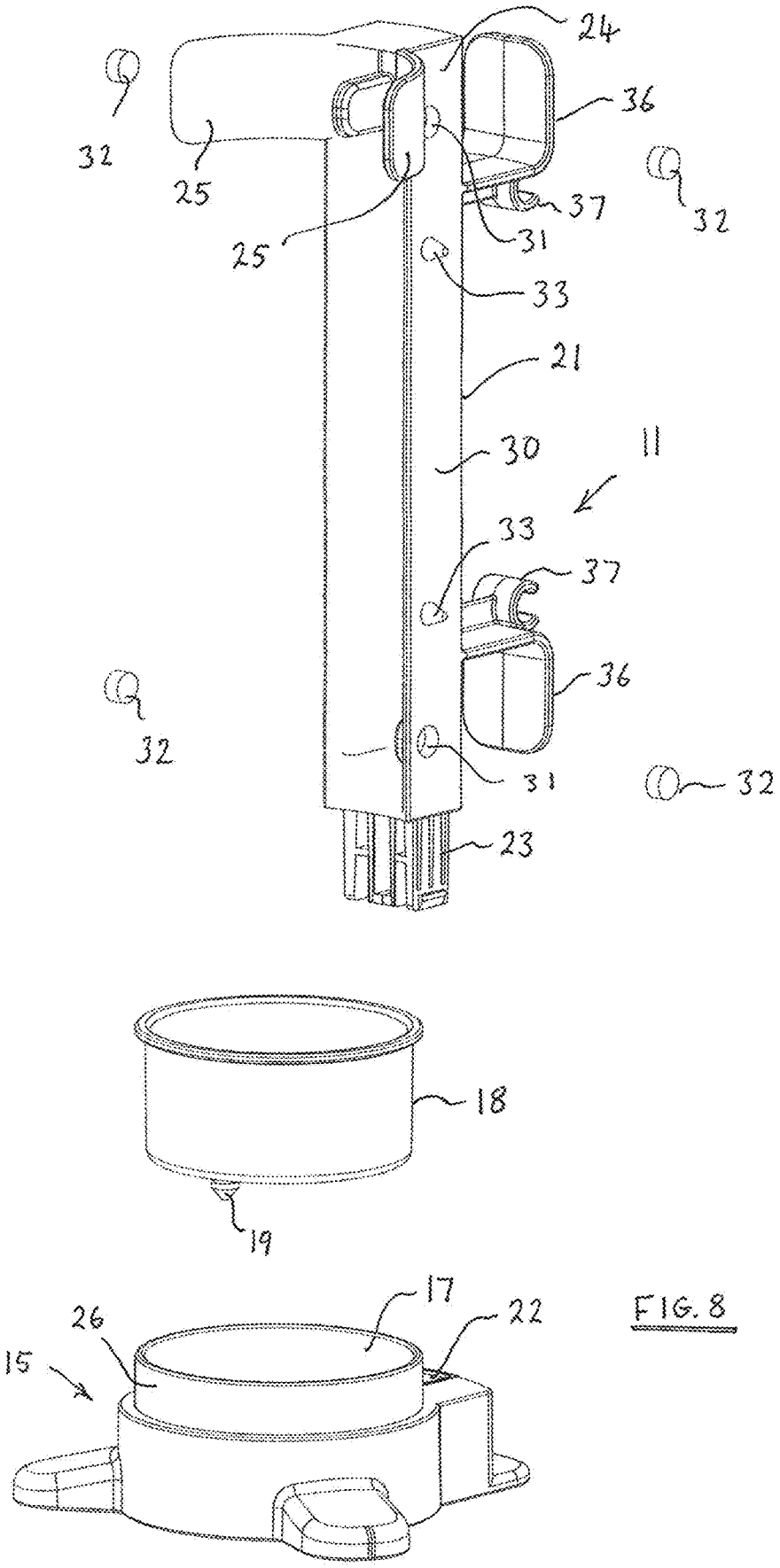
FIG. 8 is an exploded perspective view of the support stand of FIG. 7.

The base section, which may be formed from moulded plastics material, defines a cavity 17 (see FIG. 8) in which a heat resistant cup 18 is located. The base of the cup 18 comprises a pair of downwardly extending protrusions 19 which locate as a click fit in respective apertures 20 of the base section (see FIG. 6).

The support stand additionally comprises a column section 21 and the base section 15 defines a location cavity 22 into which the lower end 23 of the column section may be non-removably secured as a click fit.

The upper end 24 of the column section provides support for two part-circular arms 25 which are each moulded integrally with the plastics material of the column section. The part-circular arms 25 each have an outer surface having a radius of curvature the same or substantially the same as that of the outer surface 26 of the base section 15. The distal ends of the arms 25 are spaced apart thereby to define a gap through which part of a styling tool may be moved, in a direction sideways relative to the length direction of the column section, when the flexible sheet 12 is not secured to the support stand.

The column section 21 defines a pair of flat elongate abutment surfaces 30 to each of which an edge of the flexible sheet 12 may be secured. The abutment surfaces each extend lengthwise for substantially the whole of the length of the column section and in this embodiment they face outwards in opposite directions.

Each abutment surface 30 comprises two recesses 31 into each of which a small button magnet 32 is adhesively secured.

Each abutment surface 30 also comprises two frusto-conically shaped protrusions 33 each for engaging with a corresponding depression 34 in an edge of the support sheet.

A rear face 35 of the column section has moulded integrally therewith a pair of spaced apart cable supports 36 each having an integrally formed cable clip 37 whereby the cable of an electrically heated styling tool may readily by wound around the supports 36 and secured to one of each of the clips 37 for storage.

Figure 9:
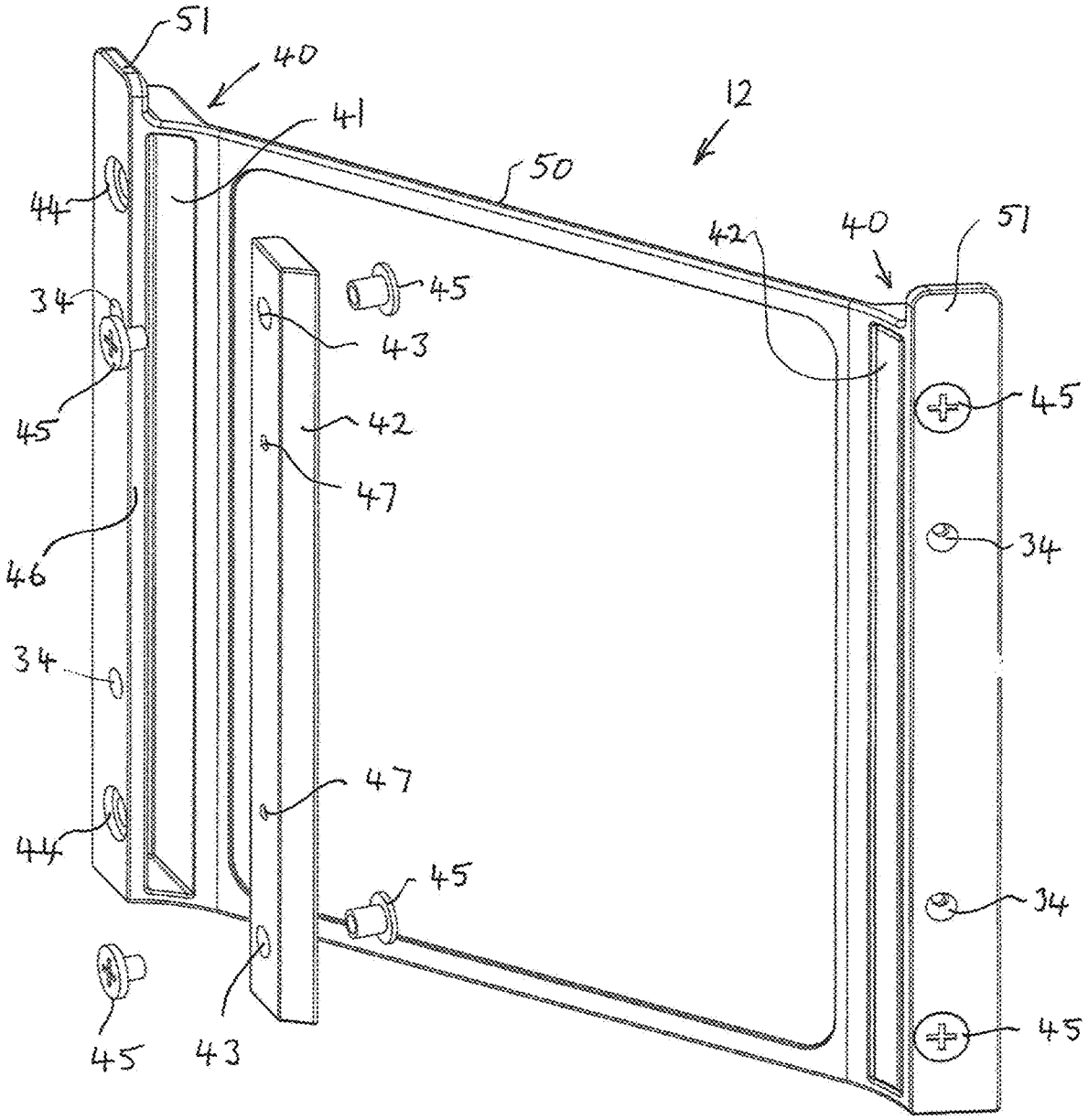
FIG. 9 is an exploded perspective view of the support mat of FIG. 7.

The flexible silicone sheet 12 (see FIG. 9) is of a square shape and comprises two opposite edges 40 each of which defines a pair of the aforedescribed depressions 34.

Each edge 40 is moulded to define an elongate cavity 41 into which a plastics reinforcing bar 42 is located.

Each reinforcing bar 42 comprises a pair of apertures 43 aligned with apertures 44 in that region of the edge which defines an outer wall 46 of the cavity 41. For each aperture 43 a pair of inter-engagable studs 45 enable the reinforcing bar to be secured in position within the cavity 41.

Each stud 45 is of ferrous material and the two apertures 43 are spaced apart by a distance corresponding to the spacing of the two magnets 32 secured to an abutment face 30 of the support stand column section. Accordingly, when an edge 40 of the flexible sheet 12 is moved into contact with the column section, the magnets 31 are able to interact with the exposed studs 45 to secure the sheet edge 40 to the support stand.

Although the small dimensions of the magnets 32 and studs 45 will tend to ensure that the sheet edge is in or close to a required position relative to the support stand, more accurate alignment is achieved by virtue of the frusto-conically shaped protrusions 33 which engage with the apertures 34 in the outer wall section of the cavity 41, those apertures 34 being through bores which terminate with correspondingly positioned depressions 47 in the reinforcing bar 42.

Figure 7:
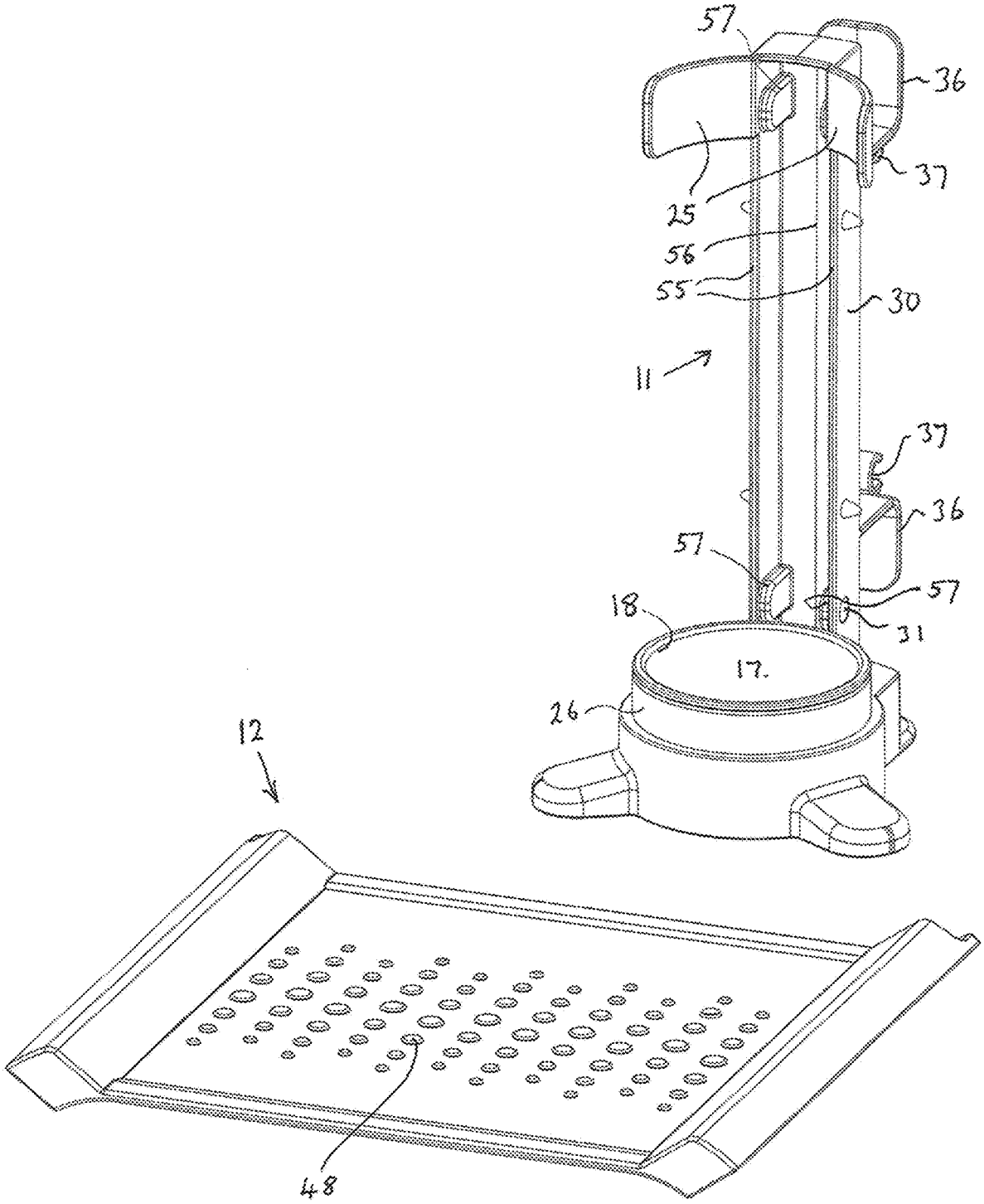
FIG. 7 is a perspective view of the flexible mat and support stand of the tool holder of FIG. 1 when separated from one another.

The face of the silicone sheet, opposite that at which the studs 45 are exposed, is formed with an array of small protrusions 48 which provide enhanced slip resistance when the matt is laid flat on a support surface (see FIG. 7) and which provide an outwardly facing decorative effect when the sheet is in situ supported by the support stand.

Although the flexible sheet 12 is of a substantially square shape, each of the edges 40 extends outwards beyond an edge 50 of the sheet that extends between the edges 40 thereby to define a pair of upstanding lugs 51. The lugs are positioned and dimensioned such that when an edge 40 is secured to an abutment face 30 of the support stand, the associated lug 51 extends upwards beyond a respective one of the pair of the arms 25 of the column section thereby conveniently to enable the edge 40 of the flexible sheet to be urged away from the column section against the magnetic attraction force exerted by the magnets 33 in cooperation with the outer studs 45 of each of the pairs of inter engaged studs.

Having regard to the foregoing it will be appreciated that having secured one edge 40 of the heat resistant flexible sheet 12 to one of the abutment faces 30 of the support stand column section, the remainder of the sheet may readily be wrapped around the arms 25 and outer face 26 of the base section thereby to bring the other edge 40 into alignment with the other abutment face 30 of the column section such that the flexible sheet is fully supported by and secured to the support stand.

Although the column section may be of a solid cross section, for the purpose of minimising weight of that part of the tool holder extending above the base section 15, it may be of a substantially C shaped section (see FIG. 6) comprising a pair of side walls 55 and an intervening wall 56. Accordingly the outer face of each wall section 55 defines one of the abutment surfaces 30, and the inward facing surfaces of the walls 55 are each provided with thickened regions 57 that define the outwardly facing cavities 31 into which the magnets 32 are adhesively secured.

The invention claimed is:

1. A tool holder, comprising:

a protective wall; and a support stand, which provides support for the protective wall that at least in part defines an enclosure within which a tool may be stored, said protective wall comprising a sheet of heat resistant material which at least in part is selectively releasable from and securable to the support stand, said sheet of heat resistant material being a flexible sheet configured to secure to the support stand in a first orientation, said flexible sheet further configured to be releasable from the support stand to provide in a flat second orientation a substantially flat heat resistant mat on which to rest a heated tool during periods of use of the tool.

2. The tool holder according to claim 1, wherein the flexible sheet is wholly removable from the support stand.

3. The tool holder according to claim 1, further comprising:

a magnet whereby at least in part the flexible sheet is securable magnetically to and is removable from the support stand.

4. The tool holder according to claim 3, wherein the magnet is secured to one of the flexible sheet and or the support stand, and wherein an other one of the flexible sheet and the support stand comprises a magnetic element which cooperates with the magnet to releasably secure the flexible sheet to the support stand.

5. The tool holder according to claim 4, wherein positions and dimensions of the magnet and the magnetic element enable the flexible sheet to be magnetically secured to the support stand only at one position or within a predetermined range of positions of the sheet material relative to the support stand.

6. The tool holder according to claim 3, wherein the magnet is a button magnet.

7. The tool holder according to claim 1, wherein an edge of the flexible sheet incorporates a substantially rigid reinforcing element that is a magnetic element.

8. The tool holder according to claim 1, wherein the flexible sheet is of a substantially rectangular shape and each of two opposite edges of the sheet comprises a substantially rigid reinforcing element.

9. The tool holder according to claim 1, wherein the support stand comprises a base section adapted to provide a support on which an end of a heated tool may rest.

10. The tool holder according to claim 9, wherein the base section defines an abutment surface against which an edge of the flexible sheet may abut when secured to the support stand.

11. The tool holder according to claim 9, wherein the base section comprises a floor section on which the end of a tool may rest, and said floor section is surrounded by an upstanding rim.

12. The tool holder according to claim 9, wherein the support stand comprises a column section which extends upwards from the base section.

13. The tool holder according to claim 12, wherein at least one magnetic element is secured to the column section.

14. The tool holder according to claim 12, wherein the column section defines two attachment surfaces each for attachment of a respective edge of the flexible sheet, whereby the sheet is wholly removable from the support stand.

15. The tool holder according to claim 12, wherein the column section comprises an abutment section which extends outwards from an upper end region of the column section for support of the flexible sheet.

16. The tool holder according to claim 15, wherein said abutment section comprises a pair of support arms, and wherein distal ends of said pair of support arms are spaced apart.

17. The tool holder according to claim 12, wherein the column section comprises a cable storage facility.

18. The tool holder according to claim 1, wherein the flexible sheet comprises a tab section which extends from an edge of the sheet to facilitate separation of the flexible sheet from the support stand.

19. The tool holder according to claim 1, wherein the support stand comprises a column section provided with a protrusion or recess for cooperation with a respective recess or protrusion of the flexible sheet.

20. The tool holder according to claim 1, wherein at least one edge of the flexible sheet is provided with a magnetic element.

* * * * *